United States Patent [19]

Kearney

[11] Patent Number: 4,594,861

[45] Date of Patent: Jun. 17, 1986

[54] FAN VOLUTE AND SPREADER

[75] Inventor: Anthony D. Kearney, St. Marys, Australia

[73] Assignee: Coolair Corporation PTE., Ltd., Singapore

[21] Appl. No.: 612,037

[22] Filed: May 18, 1984

[30] Foreign Application Priority Data

May 18, 1983 [AU] Australia ..... PF9416

[51] Int. Cl.[4] ..... F28D 5/00

[52] U.S. Cl. ..... 62/304; 261/106; 261/103; 261/97

[58] Field of Search ..... 261/DIG. 3, 106, 97, 261/103, 94, 95; 62/304, 308, 309

[56] References Cited

U.S. PATENT DOCUMENTS 2,031,055 2/1936 McKinney ..... 261/103

2,396,741 3/1946 McCombs ..... 261/103

*Primary Examiner*—Henry Bennett

*Attorney, Agent, or Firm*—Henry Sternberg; Bert J. Lewen

[57] ABSTRACT

A single monolithic moulding of a fan volute and water spreader for an air cooler. There is provided at least one shelf, either on the volute or on the spreader, which supports the spreader from the volute, the spreader being of generally curved shape and outstanding from the outer surface of the volute. Link means hinge the spreader to the volute to enable the spreader to be tilted, for example for replacement of an absorptive pad which can depend from the spreader.

6 Claims, 5 Drawing Figures

FAN VOLUTE AND SPREADER

This invention relates to a combination of a volute, or scroll, of a centrifugal type fan, and a water spreader which is useful for spreading the flow of water to be discharged over a surface of a woodwool (or other absorptive) pad in an evaporative type air cooler. The invention also extends to an air cooler which embodies such a combination.

BACKGROUND OF THE INVENTION

The usual air cooler (air conditioner) of the evaporative type employs a centrifugal type fan which draws air through a moist pad of woodwool or other absorptive material, and discharges it to the space which is to be cooled. One commonly used arrangement employs a semi-circular plate with a plurality of radiating ribs on its upper surface, and a depending flange, the flange overlapping the upper edge of a curved woodwool pad which depends from it and is supported at its lower ends by a support structure. Reference can be made to our co-pending Australian Application No. PF 9415 entitled "Water Distributions Means for Air Cooler".

For the sake of compactness, it is usual for the woodwool pad to partly surround the fan volute casing, and some effort is usually made to reduce the likelihood of "short circuit" of droplets of water into the air stream which can occur if air is free to pass between the water spreader and the absorptive pad.

The main object of this invention is to provide an effective combination of fan volute and spreader which will reduce the need to have a separate spreader, and provide a very compact and effective support means for an absorptive pad, and which will be inexpensive in production. Another object is to provide means whereby the pad replacement is simplified.

BRIEF SUMMARY OF THE INVENTION

The invention resides in a single monolithic moulding of a fan volute and water spreader for an air cooler. There is provided at least one shelf, either on the volute or on the spreader, which supports the spreader from the volute, the spreader being of generally curved shape and outstanding from the outer surface of the volute. Link means hinge the spreader to the volute to enable the spreader to be tilted, for example for replacement of an absorptive pad which can depend from the spreader.

More specifically, the invention consists of a combination fan volute and spreader, one of which comprises a shelf which engages the other and thereby locates and supports the spreader from the volute, the spreader being of curved shape and outstanding from the outer surface of the volute, and link means hinging the spreader to the volute; the volute, spreader and link means all being one monolithic moulding of polymeric material.

The link means are moulded as pairs of links having reduced section areas one at each end of each link interconnecting the spreader to a gusset or other support outstanding from the volute casing. This enables the spreader to be moved with respect to the volute casing, and to be supported by the outstanding shelf. By this means, the moulding of the spreader is simplified and the hinged arrangements of the links enable the spreader to be tilted and the absorptive pad to be replaced without removing the volute casing or spreader, being a matter of convenience for a user.

The method of assembling a woodwool (or other absorptive) pad to the curved spreader is to tilt the spreader with respect to the volute casing of a fan of an evaporative cooler, clip the woodwool pad to the undersurface of the curved spreader, and lower the spreader to rest upon the shelf, with the woodwool depending from the spreader, and locate the lower edge of the woodwool pad in location means carried in the cooler case.

An embodiment of the invention is described hereunder in some detail with reference to, and is illustrated in, the accompanying drawings, in which.

Figure 1:
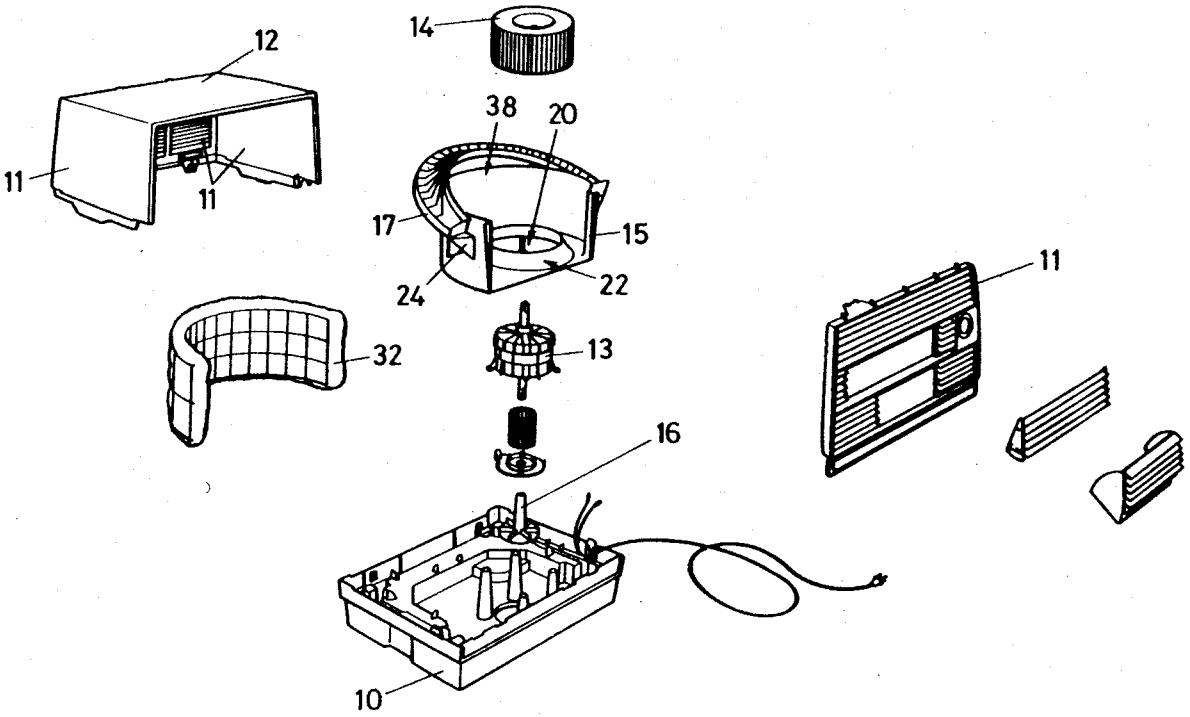
FIG. 1 is an "exploded" perspective view of a cooler.
Figure 2:
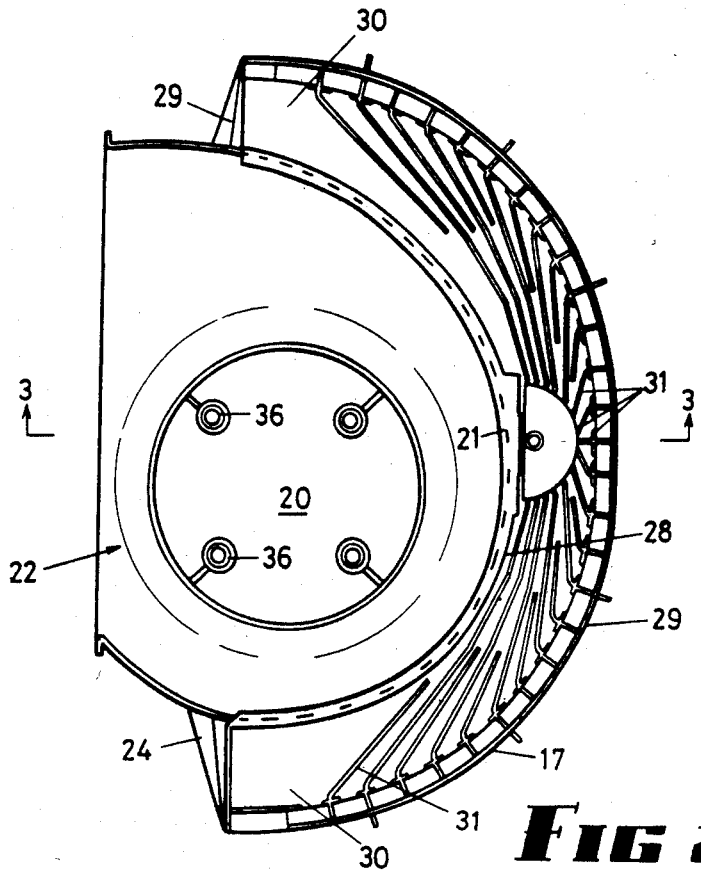
FIG. 2 is a plan view of a fan volute and spreader moulding.

In this embodiment, an evaporative cooler case is provided with a base tank 10, side walls 11 and a top wall 12 forming a case extending upwardly from the base tank 10, an electric motor 13, a centrifugal type fan 14 within a volute casing 15, a pump 16 and a spreader 17.

The spreader 17 and portion of the volute casing 15 are constituted in a single monolithic moulding. The moulding includes a central air inlet aperture 20 which also accommodates the shaft of the fan, and also includes a shelf 21 which is either radially outstanding from the outer surface of the volute casing 15, or, as shown, comprises a flange which extends at least part way around the spreader and is directed radially inwardly from the spreader 17 and supported by an upper edge of the volute casing. Air outlet opening 22 exists in the side of the volute, but the volute is a single hollow moulding, open at the top, but closed, upon assembly, by the top wall 12 of the cooler case.

There are provided a pair of gussets 24 substantially opposite one another and outstanding from the volute casing 15, and in the moulding, these gussets are connected to the curved spreader 17 by means of respective pairs of links 25. Each link 25 is moulded to have reduced thickness ends to provide "living hinges" 26 between a gusset 24 and the ends of the curved spreader 17. The material used is polypropylene, which has the ability to flex with only a small fatigue rate.

The curved spreader 17 is formed to have an upstanding flange 28, and a depending outer rim 29 which extends downwardly and between the flange 28 and rim 29 is a downwardly and outwardly sloping plate 30 which comprises a plurality of upstanding and outstanding ribs 31 which separate a stream of water when fed onto the spreader from its inlet tube into a plurality of small streams which descend from the spreader over the outer surface of a woodwool pad 32.

The undersurface of the spreader is provided with a plurality of retention lugs 34 and these engage the wire frame of a woodwool pad. Since each link is pivoted at both ends, the spreader can be lifted up so that its shelf 21 rests on a supporting edge or surface of the volute casing, or can be tilted upwardly away therefrom for positioning of a new woodwool pad assembly, as shown in FIG. 4, in dotted lines.

Figure 3:
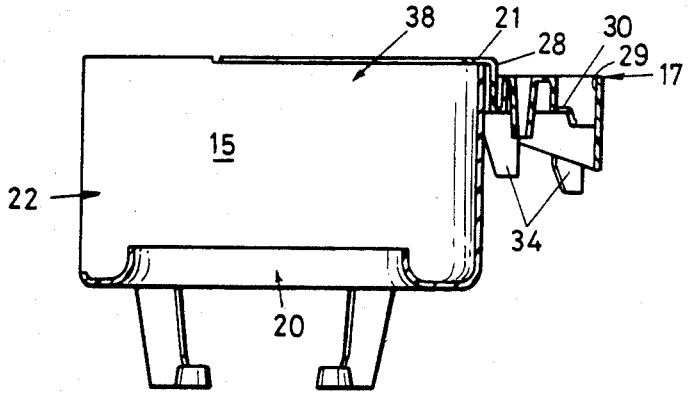
FIG. 3 is a section taken on line 3—3 of FIG. 2.
Figure 4:
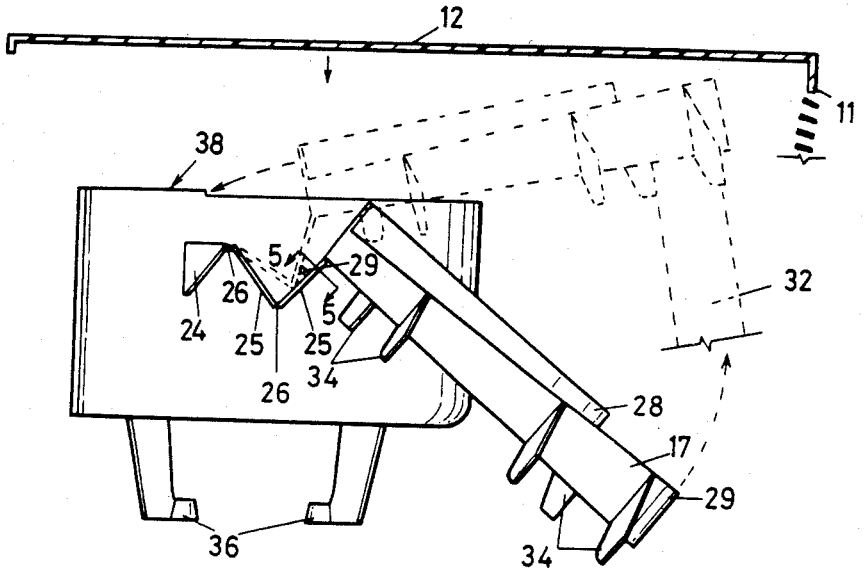
FIG. 4 is a side elevation, which illustrates the hinging of the spreader with respect to the volute casing.
Figure 5:
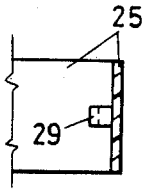
FIG. 5 is a fragmentary section taken on line 5—5 of FIG. 4.

When the spreader 17 is folded from the position shown in FIG. 4, back to the position shown in FIG. 3 wherein shelf 21 rests on the upper supporting edge of volute casing 15, the two links 25 of each pair of links come into face-to-face contiguity, and barbed latch 29 projecting from one link enters an aperture in the other link to retain such contiguity, which can however be broken by deflection of the latch.

The volute 15 is supported from the base tank 10 by four circumferentially spaced legs 36, and is moulded as a single hollow moulding. (In prior art coolers, for example as illustrated in our U.S. Pat. No. 4,338,264, fan volutes usually comprise at least two parts which are subsequently assembled). The upper open end 38 of the volute casing 15 is closed by the top wall 12 of the cooler case upon assembly, this avoiding the need for a separate closure.

I claim:

1. In an air cooler of the evaporative type having a centifugal type fan, an absorptive pad, and a water spreader which spreads a stream of water into a film which is discharged into the absorptive pad;

a combination fan volute and spreader, one of which comprises a shelf which engages the other and thereby locates and supports the spreader from the volute, the spreader being of curved shape and outstanding from the outer surface of the volute, and link means hinging the spreader to the volute; said volute including a casing having an upper edge and the volute, spreader and link means all being one monolithic moulding of polymeric material, said shelf comprising a radially inwardly directed flange extending at least part way around the spreader and supported by said upper edge of said volute casing.

2. A combination fan volute and spreader according to claim 1 wherein said link means comprise two pairs of links, each link having reduced thickness ends to provide living hinges, each pair of links extending between the volute casing and the spreader in such a way that the spreader can be moved from said position where it is supported by said shelf from the volute, to a tilted position away from the volute.

3. A combination fan volute and spreader according to claim 2 further comprising a pair of gussets outstanding from the volute, a said link of each said pair being hinged to a respective said gusset.

4. A combination fan volute and spreader according to claim 2 further comprising releasable interconnecting barbed latches between the links of each respective said pair of links, which, upon engagement, retain the links of each said pair in face-to-face contiguity, and retain the spreader in said position where it is supported by said shelf from the volute.

5. An air cooler according to claim 1, further, comprising a cooler case having a base tank, side walls and a top wall, an electric motor, a centrifugal fan within a volute casing, a pump and a spreader.

6. An air cooler according to claim 5 wherein said volute is a single hollow moulding having an air inlet aperture in its base, an air outlet opening at the side, but is open at the top, the top being closed by said top wall of the cooler case upon assembly of the volute into the cooler case.

* * * * *